US007321189B2

(12) United States Patent
Buschmann

(10) Patent No.: US 7,321,189 B2
(45) Date of Patent: Jan. 22, 2008

(54) WEDGE LEAD LAMP

(75) Inventor: Jeffrey P. Buschmann, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 17 days.

(21) Appl. No.: 11/029,604

(22) Filed: Jan. 5, 2005

(65) Prior Publication Data

US 2006/0145583 A1 Jul. 6, 2006

(51) Int. Cl.
*H01J 5/48* (2006.01)

(52) U.S. Cl. ..... 313/318.01; 313/315

(58) Field of Classification Search ..... 313/315, 313/317, 318.07, 318.11, 578, 580, 623, 625, 313/626, 274, 262
See application file for complete search history.

(56) References Cited

U.S. PATENT DOCUMENTS 4,429,249 A * 1/1984 Tyler et al. ..... 313/113
5,093,601 A * 3/1992 Watanabe et al. ..... 313/25
6,411,021 B1 * 6/2002 Izawa et al. ..... 313/315

* cited by examiner

*Primary Examiner*—Vip Patel
(74) *Attorney, Agent, or Firm*—William E. Meyer

(57) ABSTRACT

A pin lead incandescent lamp may be adapted for use in wedge type sockets. Opposed planar faces may be attached to the pins, enabling coupling to corresponding socket faces. Resilient U shaped pieces may be welded to the pins providing a simple coupling with a secure spring or friction coupling to standard wedge type socket.

10 Claims, 3 Drawing Sheets

WEDGE LEAD LAMP

BACKGROUND OF THE INVENTION

1. Field of the Invention

The invention relates to electric lamps and particularly to electric lamps with press-seals. More particularly the invention is concerned with press-seals to be fitted in wedge type sockets.

2. Description of the Related Art Including Information Disclosed Under 37 CFR 1.97 and 1.98

Prior art wedge lamps have a relatively small press-seal thickness. The leads are also thin and are easily bent. The combination allows the lead wires to be bent back over the press-seal. The total thickness is not great and a wedge type sockets have been developed to receive these lamps with bent over lead wires. Larger lamps have a thicker press-seal dimension and have heavier wires. The lead wires are not easily bent over the press-seal, and even if they could be, the combined thickness is too large to be received in the existing wedge type sockets. As a result, brighter and more efficient tungsten halogen type lamps have not been used in standard wedge type sockets. There is then a need for a larger lamp or tungsten halogen lamp that can be fitted to existing wedge type sockets.

BRIEF SUMMARY OF THE INVENTION

A larger, more efficient incandescent lamp may be adapted to a wedge type socket by restructuring the lead connections. The lamp includes a light transmissive envelope defining an enclosed volume; and has a press-sealed end. A filament type light source is positioned in the defined volume. A first electrical lead passes through the press-sealed end, and has a first end electrically coupled to the filament and has a second end extending along a first axis away from the press-seal, and is exposed on the lamp exterior for electrical connection. A second electrical lead passes through the press-sealed end, having a first end electrically coupled to the filament and having a second end extending along a second axis away from the press-seal, and is exposed on the lamp exterior for electrical connection. The second end of the first lead includes a first contact face and a second contact face. The first contact face and the second contact face are offset one from the other, and each contact face is approximately parallel to the other and to the first lead axis. The second end of the second lead may include a similar first contact face and a similar second contact face.

DETAILED DESCRIPTION OF THE INVENTION

Figure 1:
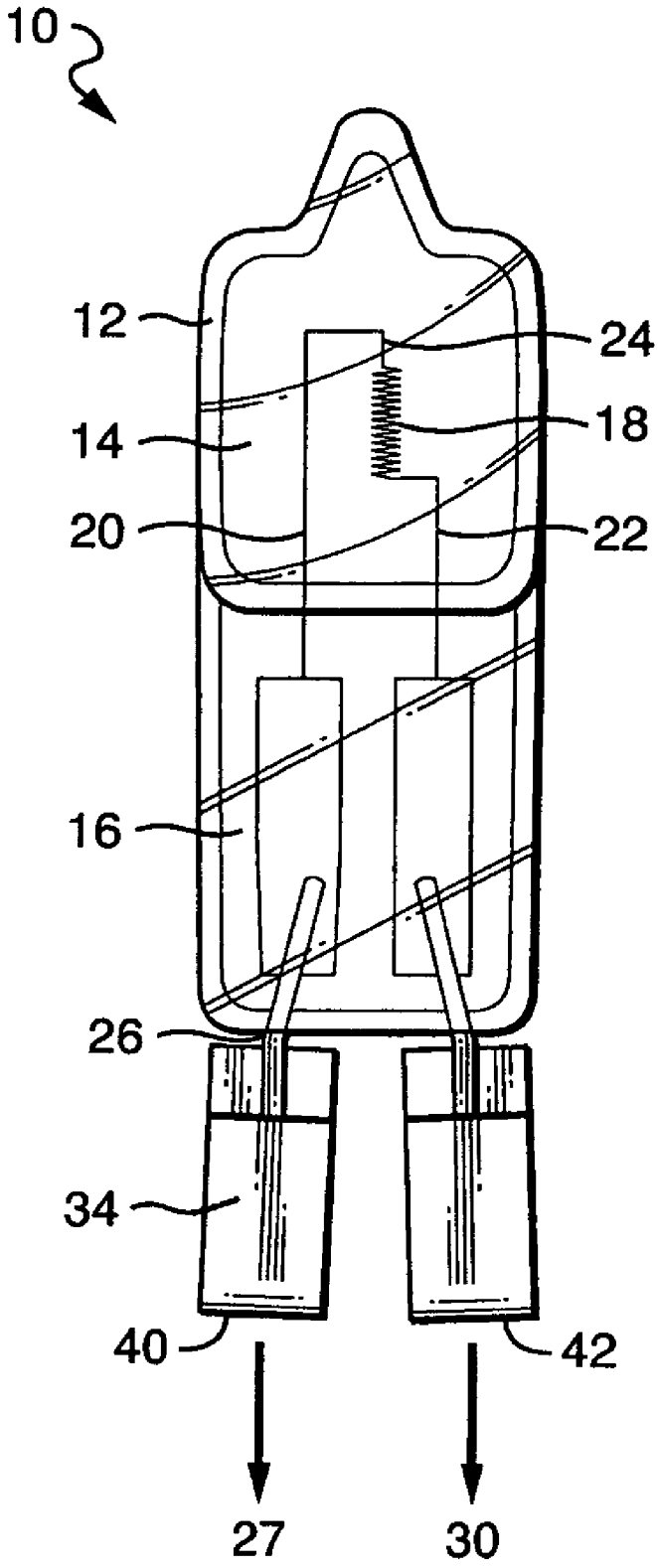
FIG. 1 shows a front perspective view of a press-sealed lamp.
Figure 2:
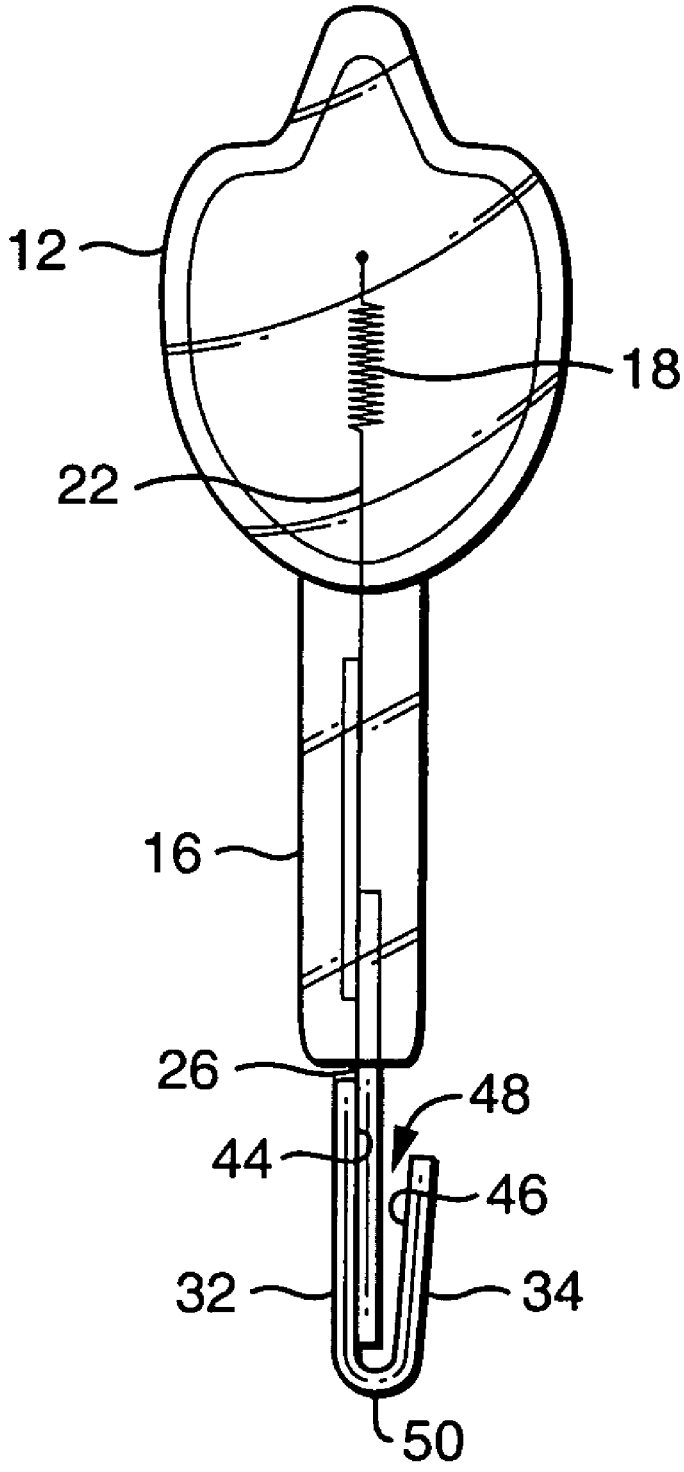
FIG. 2 shows a side perspective view of the press-sealed lamp of FIG. 1.

The preferred lamp 10 is an incandescent lamp, such as a tungsten halogen lamp capsule, with a light transmissive envelope 12 defining an enclosed volume 14. The envelope 12 may have any convenient shape, although the Applicant prefers an axially aligned tube. The envelope 12 includes a press-sealed end 16. FIG. 1 shows a front perspective view of a press-sealed lamp. FIG. 2 shows a side perspective view of the press-sealed lamp of FIG. 1.

Positioned in the defined volume 14 is a filament that serves as the preferred type light source 18. It is understood that any other convenient light could be used, such as a high or low-pressure discharge, LED, glow discharge or other light source.

The light source 18 is electrically powered through two lead connections. The first electrical lead 20 passes through the press-sealed end 16. The first electrical lead 20 has a first end 24 electrically coupled to the light source 18 (filament) and has a second end 26 that is extended along a first axis 27 through the press-seal 16 and then axially away from the press-seal 16, and where second end 26 is exposed on the lamp 10 exterior for electrical connection.

Similarly a second electrical lead 22 passes through the press-sealed end 16, and has a similar first end electrically coupled to the light source (filament) and has a second end extended through the press-seal 16 and then along a second axis 30 and away from the press-seal 16, where the second lead end is also exposed on the lamp 10 exterior for electrical connection.

The second end 26 of the first lead 20, the portioned exposed on the lamp exterior includes two contact faces 32, 34. The first contact face 32 and a second contact face 34 are offset one from the other, generally having a width and breadth sufficient to make good electrical contact in a wedge type socket, and generally planar in form (or modified planar as described below). Each of the two contact faces 32, 34 is approximately parallel to each other. Approximately parallel here means, actually parallel or within about 25 degrees of being parallel. The two contact faces 32, 34 may be frictionally wedged in contact with corresponding socket faces. When the contact faces 32, 34 are actually closely parallel; the socket may be formed with corresponding faces to frictionally pinch the second lead end along the two exposed contact faces 32, 34. As the angle of inclination between the two contact faces 32, 34 increases, it becomes more difficult to securely pinch the two contact faces 32, 34 in electrical and mechanical contact. The preferred contact faces 32, 34 are approximately planar, as they are easily manufactured that way, but they may be curved, toothed, staircased, rippled or similarly shaped. It is only important the contact faces 32, 34 slidingly pass against corresponding mating faces formed on a retaining socket, and are subsequently reasonably retained in position mated to the corresponding socket faces. The preferred second end of the second lead 22 similarly includes a similar first contact face and a second contact face, the first contact face and the second contact face of the second lead 22 are also offset one from the other with each being approximately parallel to each other and to the second lead axis. In the preferred embodiment the contact faces 32, 34 of the first lead 20 and the similar faces of the second lead 22 are all approximately parallel with the broad faces of the press-seal 16.

In a preferred embodiment, each second lead end (26) is formed as a cylindrical rod that extends from the press-seal 16, approximately parallel to the other second lead end (shaft). Welded to each of the distal ends of the shafts are U shaped resilient pieces 40, 42 formed from flat stock metal. The first U piece 40 has an interior face 44 that is welded to the exposed lead end 26. The first U piece 40 has a second interior face 46 that offset from the lead end 26 with a gap 48 formed between the lead end 26 and the second U interior face 46. The exterior faces the U shape piece 40 form the contact faces 32, 34. The U shape piece 40 has a bottom side 50 that forms a wedge that initially enters and centers the contact faces 32, 34 against corresponding socket faces. In the preferred embodiment, the U piece 40 is anchored to the exposed lead end 26, for example by welding. The second side of U piece 40, between faces 34 and 46 acts as resilient spring tensioning the contact faces 32, 34 against corresponding socket faces. It is understood that the socket faces may include resilient mating faces for contacting the contact faces 32, 34. In this way the lamp 10 may be wedged into the socket, and held in place by friction or spring tension.

Figure 3:
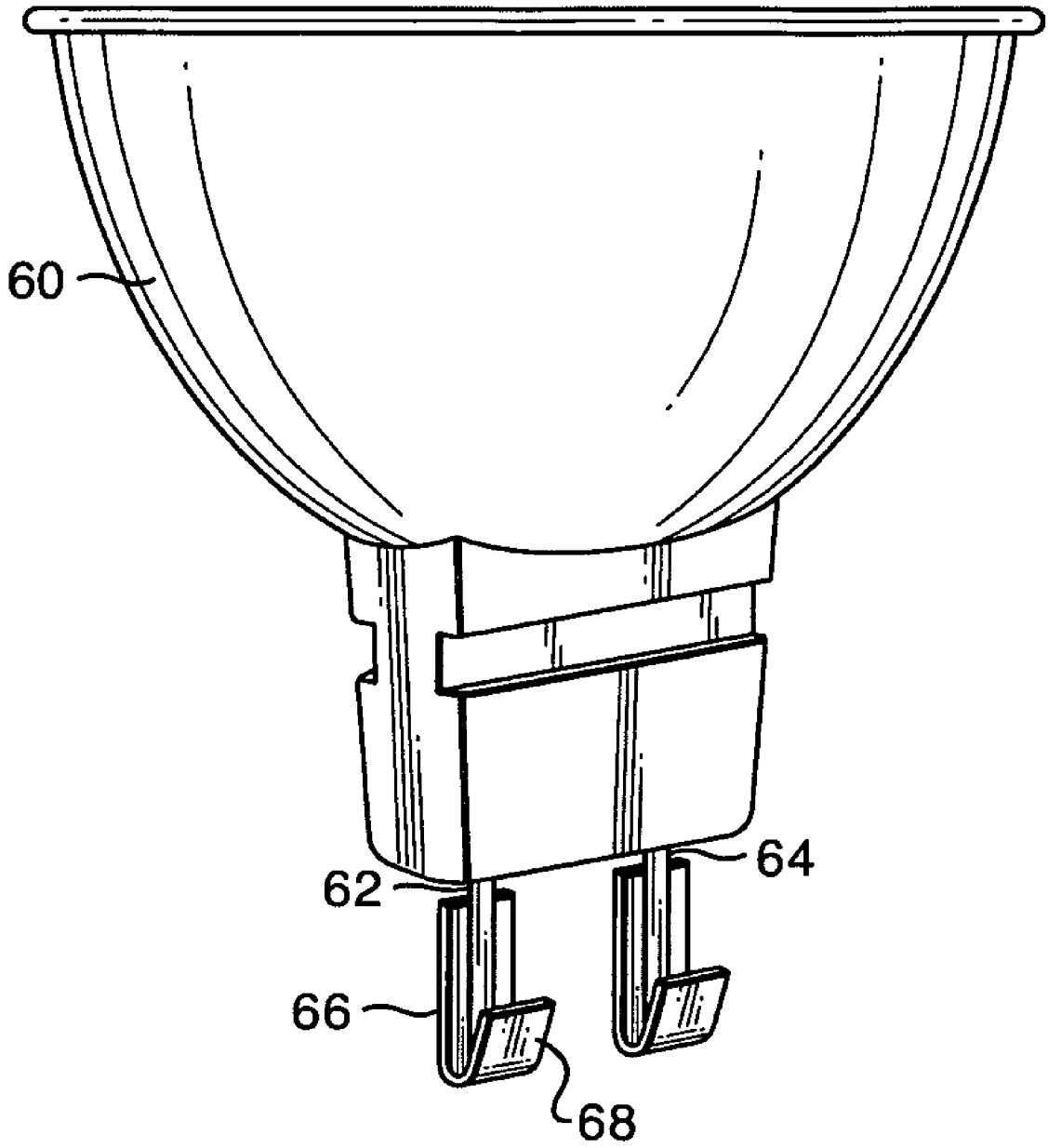
FIG. 3 shows a perspective view of a press-sealed lamp with a reflector.

FIG. 3 shows a perspective view of a press-sealed lamp with a reflector 60. It is convenient to use small press sealed lamps with surrounding reflectors. The reflector body may be formed with a penetrating passage that the press seal of the lamp maybe positioned in. The lamp and reflector are optically aligned and cemented or otherwise coupled together. The lamp leads 62, 64 then extend rewards from the reflector 60. The transverse thickness of the lamp press, the cement layer and the surrounding reflector defining the passage is far too thick to be admitted in a wedge type socket. By similarly forming the lamp lead ends extending form the press seal with opposed faces 66, 68 whose transverse separation fits the socket face separation in a wedge type socket, for example by appending springing U shaped adaptations on the lead ends, the light source and reflector combination may be adapted for use in a wedge type socket. A tungsten halogen reflector lamp may then be used in a wedge type socket.

The wedge contacts may be applied to the ends of heavier lead wires typical of larger lamps, thereby enabling the use of larger lamps in existing wedge type sockets. The more efficient, or longer-lived, albeit larger lamps including tungsten halogen type lamps may then be used in wedge type sockets. While there have been shown and described what are at present considered to be the preferred embodiments of the invention, it will be apparent to those skilled in the art that various changes and modifications can be made herein without departing from the scope of the invention defined by the appended claims.

What is claimed is:

1. An incandescent lamp comprising:

a light transmissive envelope defining an enclosed volume; and having a press-sealed end;

a filament type light source positioned in the defined volume;

a first electrical lead passing through the press-sealed end, having a first end electrically coupled to the filament and having a second end extending along a first axis away from the press-seal, and exposed on the lamp exterior for electrical connection;

a second electrical lead passing through the press-sealed end, having a first end electrically coupled to the filament and having a second end extending along a second axis away from the press-seal, and exposed on the lamp exterior for electrical connection;

wherein the second end of the first lead includes a first contact face and a second contact face, the first contact face and the second contact face being offset one from the other and each being approximately parallel to each other and to the first lead axis; and wherein the second end of the second lead includes a first contact face and a second contact face, the first contact face and the second contact face being offset one from the other and each being approximately parallel to each other and to the second lead.

2. The incandescent lamp in claim 1, wherein the first contact face and the second contact face of at least the first lead are formed by flat sides of a conductive piece electrically coupled to the first lead.

3. The incandescent lamp in claim 1, further including a reflector shell positioned around the lamp envelope to generally face the lamp envelope on a first side of the shell, and wherein the first lead and the second lead are exposed for electrical contact on a second side of the shell.

4. The incandescent lamp in claim 1, wherein at least a portion of one contact face is resiliently extended away from the lead end with a gap intermediate the resilient portion and the lead end with no applied tension, and where by the resilient portion may be compressed towards the lead end with applied tension.

5. The incandescent lamp in claim 1, further including a reflector shell positioned around the lamp envelope to generally face the lamp envelope on a first side of the shell, and wherein the first lead and the second lead are exposed for electrical contact on a second side of the shell; and wherein at least a portion of one contact face is resiliently extended away from the lead end with a gap intermediate the resilient portion and the lead end with no applied tension, and where by the resilient portion may be compressed towards the lead end with applied tension.

6. An incandescent lamp comprising:

a light transmissive envelope defining an enclosed volume; and having a press-sealed end;

a filament type light source positioned in the defined volume;

a first electrical lead passing through the press-sealed end, having a first end electrically coupled to the filament and having a second end extending along a first axis away from the press-seal, and exposed on the lamp exterior for electrical connection;

a second electrical lead passing through the press-sealed end, having a first end electrically coupled to the filament and having a second end extending along a second axis away from the press-seal, and exposed on the lamp exterior for electrical connection;

wherein the second end of the first lead includes a resilient U shaped end with a first contact face and a second contact face, the first contact face and the second contact face being offset one from the other and each being approximately parallel to each other and to the first lead axis; and wherein the second end of the second lead includes a resilient U shaped end with a first contact face and a second contact face, the first contact face and the second contact face being offset one from the other and each being approximately parallel to each other and to the second lead.

7. The incandescent lamp in claim 6, wherein the first contact face and the second contact face of at least the first lead are formed by flat sides of a conductive piece electrically coupled to the first lead.

8. The incandescent lamp in claim 6, further including a reflector shell positioned around the lamp envelope to generally face the lamp envelope on a first side of the shell, and wherein the first lead and the second lead are exposed for electrical contact on a second side of the shell.

9. The incandescent lamp in claim 6, wherein at least a portion of one contact face is resiliently extended away from the lead end with a gap intermediate the resilient portion and the lead end with no applied tension, and where by the resilient portion may be compressed towards the lead end with applied tension.

10. The incandescent lamp in claim 6, further including a reflector shell positioned around the lamp envelope to generally face the lamp envelope on a first side of the shell, and wherein the first lead and the second lead are exposed for electrical contact on a second side of the shell; and wherein at least a portion of one contact face is resiliently extended away from the lead end with a gap intermediate the resilient portion and the lead end with no applied tension, and where by the resilient portion may be compressed towards the lead end with applied tension.

* * * * *